United States Patent [19]

Fisher et al.

[11] Patent Number: 4,489,933

[45] Date of Patent: Dec. 25, 1984

[54] EXERCISE DEVICE

[75] Inventors: Milton W. Fisher, 306 W. Farmer, Independence, Mo. 64055; Glen E. Henson, Independence, Mo.

[73] Assignee: Milton W. Fisher, Independence, Mo.

[21] Appl. No.: 548,213

[22] Filed: Nov. 2, 1983

Related U.S. Application Data

[63] Continuation-in-part of Ser. No. 406,290, Aug. 9, 1981, abandoned.

[51] Int. Cl.[3] ..... A63B 23/00; A63B 21/00

[52] U.S. Cl. ..... 272/65; 272/146

[58] Field of Search ..... 272/33 R, 146, 65, 97, 272/43, 28 R, 69, 144

[56] References Cited

U.S. PATENT DOCUMENTS

| | | | |
|---|---|---|---|
| 2,294,509 | 9/1942 | Moeller | 272/65 |
| 2,529,581 | 11/1950 | Wiepert | 272/146 |
| 3,442,509 | 5/1969 | Figura | 272/43 |
| 3,504,765 | 4/1970 | Sullivan | 272/65 |
| 3,784,193 | 1/1974 | Simjian | 272/146 |
| 4,291,873 | 9/1981 | Lee et al. | 272/146 |

FOREIGN PATENT DOCUMENTS

| | | | |
|---|---|---|---|
| 628802 | 10/1982 | European Pat. Off. | 272/146 |
| 2364675 | 5/1978 | France | 272/33 R |

*Primary Examiner*—Richard J. Apley
*Assistant Examiner*—S. R. Crow
*Attorney, Agent, or Firm*—Kokjer, Kircher, Bradley, Wharton, Bowman & Johnson

[57] ABSTRACT

An exercise device utilizing a resilient fabric sheet to form a trampoline type surface is the subject of the present invention. The flexible sheet is mounted on a framework which in turn is supported on rollers that can accommodate a turning motion. A handle bar projects upwardly to give the user of the device a hand hold while performing twisting and turning exercises. The device is constructed of extremely lightweight material which is reinforced to provide the necessary support. The device is collapsible and portable.

6 Claims, 3 Drawing Figures

EXERCISE DEVICE

This is a continuation in part of our co-pending application Ser. No. 06/406,290 filed Aug. 9, 1981, now abandoned.

BACKGROUND OF THE INVENTION

This invention relates generally to exercise devices, and more particularly, to an improved trampoline type of exercise platform which is moveable relative to a stationary base.

Various flexible bed type exercisers have become exceedingly popular in recent years. In a typical construction, a flexible fabric is supported on a frame in tightly stretched condition. Springs or other yieldable elements are employed to connect the flexible bed to a rigid frame thus allowing for a limited amount of flexing of the bed. The device may be used for running or jumping exercises.

Others have proposed exercising devices utilizing a rotatable base. For example, a massaging apparatus is shown in U.S. Pat. No. 4,026,279. A rotatable round-about for a playground which has a trampoline supported across a flat circular frame and is intended to be rotated by hand as children jump on it is shown in French Pat. No. 2,364,675. Similar types of gymnastic equipment are disclosed in Japanese Pat. No. 52-17926 and European Pat. No. 62802.

All of the foregoing described devices fail to provide a structure which will accommodate both aerobic exercise and twisting motion. The devices of the prior art are also relatively bulky and not portable.

The present invention provides, for the first time, a relatively lightweight and inexpensive platform including a rotatable trampoline type surface which is movable relative to a fixed base. The combination of the rotatable and flexible surface accommodates exercise movement not heretofore practical using prior art devices.

OBJECTS OF THE INVENTION

It is, therefore, a primary object of the present invention to provide an improved trampoline type of exerciser wherein the framework for the flexible fabric is moveable relative to a stationary base thereby providing better exercise movement than is possible with fixed frame constructions.

As a corollary to the above object, a particular aim of the invention is to provide a trampoline type of exerciser wherein flexure of the back is obtainable thereby providing easy, enjoyable and reliable back and spinal column therapy.

Another very important aim of the invention is to provide an exercise device as described in the foregoing objects which is of extremely lightweight construction and is therefore economical to manufacture and readily portable.

Other objects of the invention will be made clear or become apparent from the following description and claims when read in light of the accompanying drawing, wherein:

FIG. 1 is a perspective view of the exercise device according to the present invention; and FIG. 2 is a top plan view of the platform portion of the device of FIG. 1; and FIG. 3 is a vertical cross-sectional view taken along line 3—3 of FIG. 2.

DETAILED DESCRIPTION OF THE PREFERRED EMBODIMENT

Figure 1:
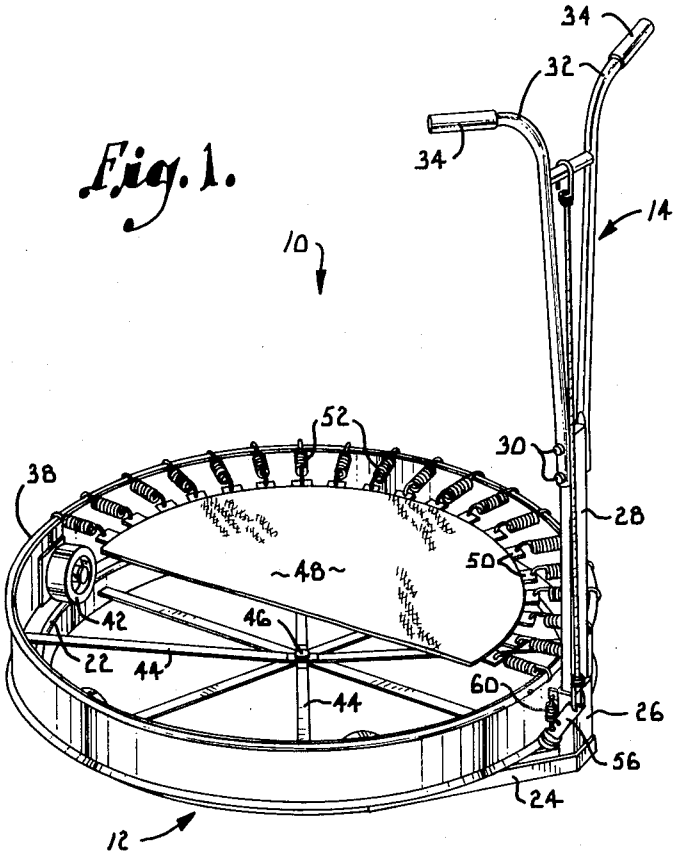

Referring initially to FIG. 1, the exercise device according to the present invention is designated generally by the number 10. Device 10 comprises a platform portion 12 and a vertical handlebar 14.

Figure 2:
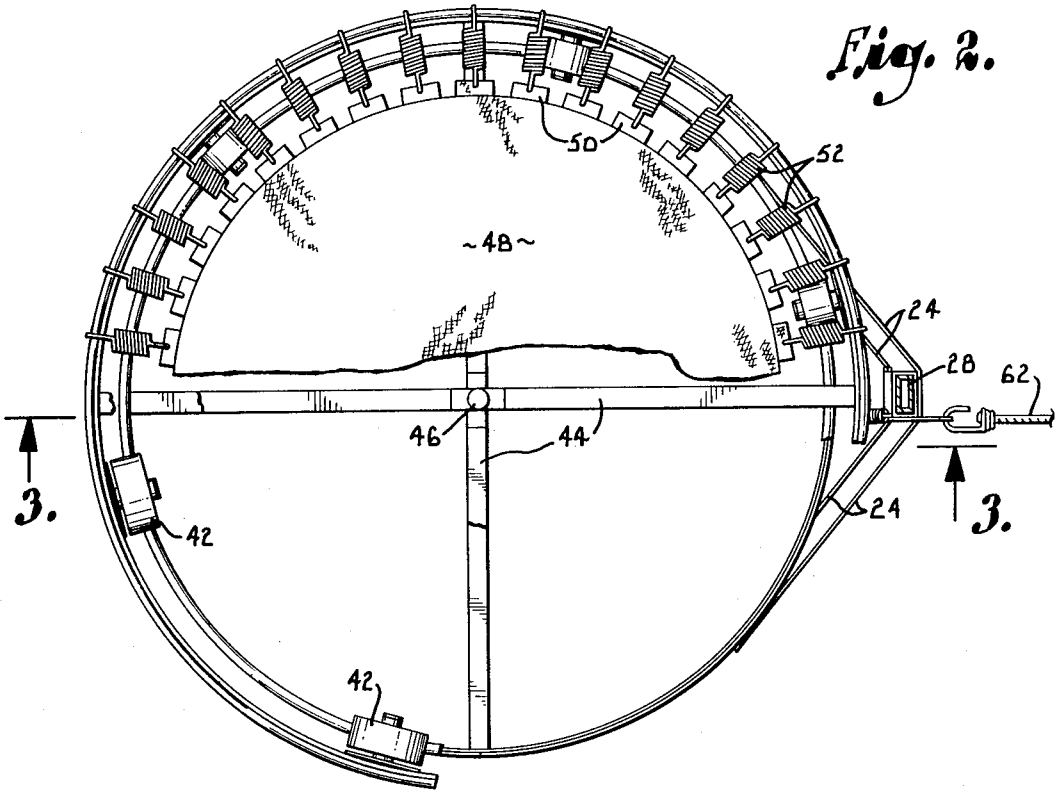
Figure 3:
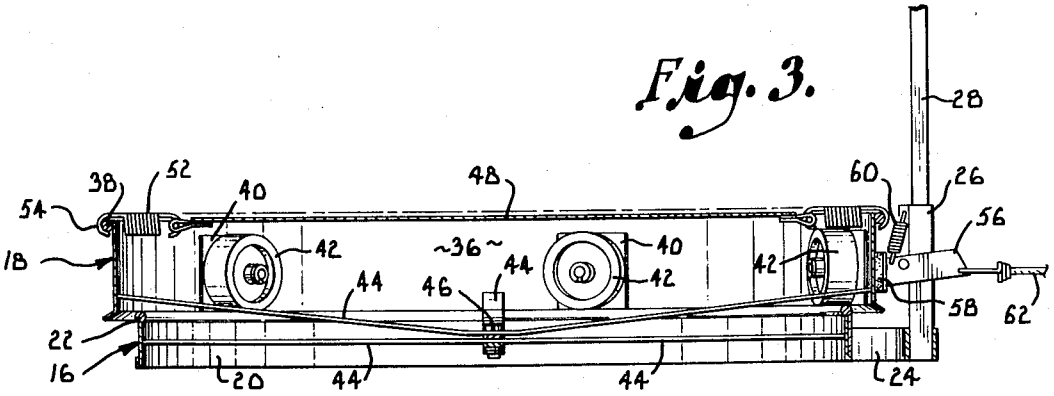

Referring to FIG. 3, it is seen that the platform 12 is comprised of a circular base 16 and an overlying circular member 18 of somewhat larger diameter.

Base 16 is characterized by a sidewall 20 of relatively lightweight construction which, by itself, is incapable of supporting the weight of the person using the device. Base 16 also includes a rim 22 that is rigid with sidewall 20 and is of generally circular cross-section. The diameter of rim 22 is approximately twice the thickness of sidewall 20.

Rigid with sidewall 20 are braces 24 which form a support for a rigid sleeve 26. Sleeve 26 receives the stem portion 28 of handlebar 14. Stem 28 is comprised of upper and lower sections which are held together at their point of juncture by bolt assemblies 30. Handlebar 14 terminates in laterally extending generally horizontal handles 32 with hand grips 34.

Circular member 18 is best shown in FIGS. 1 and 3 and comprises a relatively thin lightweight sidewall 36 which, like the sidewall 20 is characterized by being incapable of supporting a person by itself. Coupled with sidewall 36 is a rigid rim 38 extending around the upper periphery of the sidewall. This rim, like rim 22, is characterized by a circular cross-section having a diameter equal to approximately twice the thickness of the wall 36. The lower edge of this wall, which is at the opposite end from rim 38 is flared outwardly as indicated in FIG. 3.

Also rigid with sidewall 36 is a plurality of mounting brackets 40 which support rollers 42. These rollers are positioned to travel along the upper surface of rim 22 which in effect presents a track for engagement by the rollers.

Extending from both of sidewalls 20 and 36 by a plurality of spider-like cross braces 44 which converge on a point at the center of the two concentric circles defined by base 16 and member 18. A nylon rivet 46 or other low friction fastener passes through the cross braces at this point to hold base 16 and member 18 together while permitting relative rotation between the two.

A trampoline type surface is provided by a flexible sheet 48 that is preferably constructed of a synthetic mesh material such as nylon so that the individual filaments have little flexure in a vertical direction. Tabs 50 which are sewn into sheet 48 provide means for coupling a plurality of coil springs 52 to the sheet. Each of springs 52 has a hook 54 at one end which extends at least partially around rim 38. By securing hooks 54 around the entire rim, sheet 48 is tightly stretched over member 18. This manner of fastening sheet 48 eliminates the need to punch holes in sidewall 36.

Referring again to FIG. 3, pivotally mounted on sleeve 26 is a braking device 56 having a highly frictional surface 58 that is biased into engagement with sidewall 36 by a coil spring 60. This prevents rotation of member 18. Brake 56 may be released by utilizing cord 62 to pull the brake lever against the action of spring 60.

OPERATION

Device 10 is used in the same manner as other trampoline type exercising devices including for jumping, bouncing and in-place jogging. The person exercising steps upon the surface presented by fabric sheet 48 and performs the exercise with springs 52 resisting the force of the exercise movement. With the device of the present invention, however, circular twisting movement may also be accomplished by holding onto handlebar 14 while turning the body. This causes member 18 to move on rollers 42 while base 16 remains stationary. It is possible to make a complete 360° rotation although in most instances the best back therapy is accomplished with rotation of 180° to 240°.

It will also be appreciated that braking mechanism 56 be modified to provide a slight resistance to rotational movement of member 18 without applying full braking pressure. This may be desirable for some types of exercises.

It has been found that the combination of the trampoline surface and rotational movement provides back therapy which cannot be accomplished with any of the devices of the prior art. Although other twisting type platforms have been known, such devices are difficult to use and potentially dangerous because of the absence of a flexing surface which will accommodate greater twisting movement of a person's back.

The present device is also constructed of extremely lightweight material which would be incapable of supporting a person but for the unique combination of a thin sidewall of sheet material and a rigid reinforcing rim which adds strength to the sidewall this rendering it capable of supporting a person. Cross braces 44 also provide means for reinforcing the construction while also tying the two relatively movable members together. By utilizing rim 38 to support springs 52, all drilling operations in the manufacturing process are eliminated.

Thus, for the first time, a lightweight economical construction of a rebound exerciser is provided in combination with a twisting movement that is enhanced and made more usable by its combination with the flexible surface.

We claim:

1. An exercise device for a person comprising:

a circular base having a sidewall and a rim extending around the top edge of said sidewall, said sidewall being relatively lightweight and incapable of supporting a person, said rim being rigid with said sidewall and providing sufficient reinforcement whereby in combination with the sidewall a person may be supported;

a circular member having a sidewall and a rim extending around the top edge of said sidewall, said member sidewall being relatively lightweight and incapable of supporting a person, said member rim being rigid with said member sidewall and providing sufficient reinforcement whereby in combination with the sidewall a person may be supported;

roller means coupled with said circular member and depending therefrom for engagement with said base rim;

a plurality of cross braces extending from each of said base and said member, said cross braces converging on a point and being coupled together at said point to accommodate rotational movement of said member relative to said base; and resilient flexible sheet means coupled with said member rim and extending across the latter whereby to support said person exercising.

2. The invention of claim 1, wherein is included a plurality of coil springs coupling said flexible sheet with said member ring, each of said springs having hook means extending at least partially around said member rim.

3. The invention of claim 1, wherein is included handle bar means projecting upwardly from said base.

4. The invention of claim 1, wherein is included releasable brake means for locking said base relative to said member.

5. An exercise device comprising:

a circular base having a sidewall and a rim extending around the top edge of said sidewall, said sidewall being relatively lightweight and capable of supporting a person, said rim being rigid with said sidewall and providing sufficient reinforcement whereby in combination with the sidewall a person may be supported;

a circular member having a sidewall and a rim extending around the top edge of said sidewall, said member sidewall being relatively lightweight and incapable of supporting a person, said member rim being rigid with said member sidewall and providing sufficient reinforcement whereby in combination with the member sidewall a person may be supported;

roller means coupled with said circular member and depending therefrom for engagement with said base rim;

handle means rigid with said base and extending upwardly to be grasped by a person using said device;

a plurality of cross braces extending from each of said base and said member, said cross braces converging on a point and being coupled together at said point to accommodate rotational movement;

resilient flexible sheet means adapted to be stretched substantially across said member; and a plurality of coil spring means coupled with said sheet means, said spring means having hook means at one end, said hook means extending at least partially around said member rim whereby a person may exercise on said sheet means.

6. The invention of claim 5, wherein is included releasable brake means for locking said base relative to said member.

* * * * *